US010336597B2

(12) United States Patent
Griscik et al.

(10) Patent No.: US 10,336,597 B2
(45) Date of Patent: Jul. 2, 2019

(54) CAPSULE-BASED ALCOHOLIC BEVERAGE FORMING APPARATUS AND COMPONENTS THEREOF

(71) Applicant: Altria Client Services LLC, Richmond, VA (US)

(72) Inventors: Gregory James Griscik, Midlothian, VA (US); Jonathan David Watson, Richmond, VA (US); Carl Gregory Miller, Richmond, VA (US); Rosana C. Altoveros, Chesterfield, VA (US); Lawrence E. Tipton, Colonial Heights, VA (US); Jeremy Straight, Midlothian, VA (US); David Alvarez, Henrico, VA (US); John Nelson, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 287 days.

(21) Appl. No.: 15/078,608

(22) Filed: Mar. 23, 2016

(65) Prior Publication Data

US 2016/0280527 A1 Sep. 29, 2016

Related U.S. Application Data

(60) Provisional application No. 62/137,067, filed on Mar. 23, 2015.

(51) Int. Cl.
*B67D 1/00* (2006.01)
*B67D 1/12* (2006.01)
(Continued)

(52) U.S. Cl.
CPC ..... *B67D 1/0066* (2013.01); *B65D 85/8043* (2013.01); *B67D 1/0025* (2013.01);
(Continued)

(58) Field of Classification Search
CPC .. B67D 1/0066; B67D 1/0025; B67D 1/0031; B67D 1/0032; B67D 1/0037;
(Continued)

(56) References Cited

U.S. PATENT DOCUMENTS 6,234,222 B1 5/2001 Nelson
8,026,288 B2 * 9/2011 Takenouchi ..... B01D 19/0073 137/12.5
(Continued)

FOREIGN PATENT DOCUMENTS

DE 2145298 A1 3/1973
GB 2261442 A 5/1993
(Continued)

*Primary Examiner* — Phuong T Nguyen
(74) *Attorney, Agent, or Firm* — Buchanan Ingersoll & Rooney PC

(57) ABSTRACT

An alcoholic beverage forming apparatus operable to dispense an alcoholic beverage having a desired flavor, proof, temperature, and volume mixes water and alcohol with a flavor medium to form an alcoholic beverage having a desired flavor that may be dispensed from the apparatus. The apparatus includes a capsule holder, a water supply reservoir and an alcohol supply reservoir. The reservoirs are operable to respectively supply water and alcohol to a mixing manifold of the apparatus to such that the water and alcohol are combined in the mixing manifold to form an alcoholic beverage mixture which is subsequently mixed with a flavor medium contained in an interior of a beverage capsule. A dispenser is operable to dispense an alcoholic beverage therefrom during operation of the alcoholic beverage forming apparatus.

28 Claims, 8 Drawing Sheets

(51) Int. Cl.
*B67D 1/16* (2006.01)
*B67D 1/08* (2006.01)
*B65D 85/804* (2006.01)

(52) U.S. Cl.
CPC ..... *B67D 1/0031* (2013.01); *B67D 1/0032* (2013.01); *B67D 1/0037* (2013.01); *B67D 1/0039* (2013.01); *B67D 1/0057* (2013.01); *B67D 1/0078* (2013.01); *B67D 1/0869* (2013.01); *B67D 1/0872* (2013.01); *B67D 1/1204* (2013.01); *B67D 1/1238* (2013.01); *B67D 1/1295* (2013.01); *B67D 1/16* (2013.01); *B67D 1/0888* (2013.01); *B67D 2001/0812* (2013.01); *B67D 2210/0006* (2013.01)

(58) Field of Classification Search
CPC .. B67D 1/0039; B67D 1/0057; B67D 1/0078; B67D 1/0869; B67D 1/0872; B67D 1/1204; B67D 1/1238; B67D 1/1295; B67D 1/16; B67D 1/088; B65D 85/8043
USPC ..... 99/275, 279, 295, 280, 281, 285, 288, 99/300, 323; 426/231, 232, 431, 493, 426/494, 575, 592
See application file for complete search history.

(56) References Cited

U.S. PATENT DOCUMENTS 8,361,527 B2 1/2013 Winkler et al.
8,479,640 B2 7/2013 Gavillet et al.
8,586,117 B2 11/2013 Vastardis et al.
2007/0209521 A1* 9/2007 Boussemart ..... A47J 31/061 99/275
2007/0242561 A1* 10/2007 Agon ..... A47J 31/061 366/279
2010/0047386 A1 2/2010 Tatera
2010/0107878 A1* 5/2010 Crowder ..... B01D 19/0031 96/6
2010/0107887 A1 5/2010 Bentley et al.
2011/0029255 A1* 2/2011 Hyde ..... A47G 19/2227 702/25
2011/0223308 A1* 9/2011 Motzaeli ..... C12G 3/005 426/575
2012/0035761 A1 2/2012 Tilton et al.
2012/0070542 A1 3/2012 Camera et al.
2013/0136833 A1 5/2013 Vastardis et al.
2014/0072676 A1* 3/2014 Moutty ..... B65D 85/8043 426/112
2014/0076170 A1 3/2014 Epars et al.
2014/0202591 A1 7/2014 Schnyder
2014/0242224 A1* 8/2014 Glucksman ..... A47J 31/32 426/231
2014/0272006 A1 9/2014 Schuh et al.
2014/0272019 A1 9/2014 Schuh et al.
2016/0073673 A1 3/2016 Schuh et al.

FOREIGN PATENT DOCUMENTS

WO 9927070 A1 6/1999
WO 2010128028 A1 11/2010
WO 2013174010 A1 11/2013

* cited by examiner

CAPSULE-BASED ALCOHOLIC BEVERAGE FORMING APPARATUS AND COMPONENTS THEREOF

This application claims priority under 35 U.S.C. § 119(e) to U.S. Provisional Application No. 62/137,067, filed on Mar. 23, 2015, the entire contents of which is incorporated herein by reference thereto.

BACKGROUND

Beverages, including alcoholic beverages, are produced and distributed throughout the world, but shipping beverages can be cost prohibitive due to the weight thereof. Generally, beverages may include about 90 to 95% water, which is a significant portion of the weight of the beverage. Thus, the ability to create beverages as needed by the addition of water to a concentrated mixture of flavors saves significantly on costs of storage and shipping.

Moreover, stocking a bar with a large variety of fermented drinks such as beers, wines, champagnes, and liquors can be cost and space prohibitive. Additionally, the time and ingredients necessary to ferment and form various crafted beverages such as beers, wines, and liquors can be lengthy and expensive.

Additionally, consumers who are conscious of their caloric intake may prefer alcoholic drinks with reduced alcohol or sugar content, respectively.

Thus, a beverage forming apparatus operable to form a variety of alcoholic beverages that taste like various crafted beers, wines, champagnes, liquors, cocktails and/or mixed drinks is desirable wherein the alcohol by volume (ABV) and sugar content of an alcoholic beverage may be controlled.

SUMMARY

Disclosed herein is an alcoholic beverage forming apparatus operable to dispense an alcoholic beverage having a desired flavor, proof, temperature, and volume by mixing water and alcohol with a flavor medium such that the water and alcohol mix with the flavor medium to form the alcoholic beverage having the desired flavor, proof, temperature, and volume that may be dispensed from the alcoholic beverage forming apparatus. The alcoholic beverage forming apparatus comprises a capsule holder configured to receive a beverage capsule having a flavor medium in an interior thereof, a water supply reservoir operable to supply water to a mixing manifold of the alcoholic beverage forming apparatus at a predetermined temperature, an alcohol supply reservoir operable to supply alcohol to the mixing manifold of the alcoholic beverage forming apparatus at a predetermined temperature, and a dispenser operable to dispense an alcoholic beverage therefrom. The alcoholic beverage forming apparatus may also include a carbonated water source operable to supply carbonated water such that a dispensed alcoholic beverage may have a desired level of carbonation.

The predetermined amounts of the water and alcohol supplied to the mixing manifold are combined therein so as to form an alcoholic beverage mixture having a desired proof, temperature, and volume. The alcoholic beverage forming apparatus is operable to supply the alcoholic beverage mixture through an outlet of the mixing manifold to an interior of a beverage capsule held in the capsule holder during use of the alcoholic beverage forming apparatus such that the alcoholic beverage mixture may mix with a flavor medium contained in the interior of the beverage capsule to form an alcoholic beverage that may be dispensed from the dispenser of the alcoholic beverage forming apparatus.

Also disclosed herein is an alcoholic beverage forming apparatus operable to dispense an alcoholic beverage having a desired flavor, proof, temperature, and volume by mixing water and alcohol with a flavor medium such that the water and alcohol mix with the flavor medium to form the alcoholic beverage having the desired flavor, proof, temperature, and volume that may be dispensed from the alcoholic beverage forming apparatus. The alcoholic beverage forming apparatus comprises a capsule holder configured to receive a beverage capsule having a flavor medium in an interior thereof, an ambient water supply reservoir operable to supply ambient water to a mixing manifold of the alcoholic beverage forming apparatus, a cold water supply reservoir operable to supply cold water at a temperature below the ambient water temperature to the mixing manifold of the alcoholic beverage forming apparatus, an ambient alcohol supply reservoir operable to supply an ambient alcohol to the mixing manifold of the alcoholic beverage forming apparatus, a cold alcohol supply reservoir operable to supply cold alcohol at a temperature below the ambient alcohol temperature to the mixing manifold of the alcoholic beverage forming apparatus, and a dispenser operable to dispense an alcoholic beverage therefrom. The alcoholic beverage forming apparatus may also include a carbonated water source operable to supply carbonated water such that a dispensed alcoholic beverage may have a desired level of carbonation.

The predetermined amounts of the ambient water, cold water, ambient alcohol, and cold alcohol supplied to the mixing manifold are combined therein so as to form an alcoholic beverage mixture having a desired proof, temperature, and volume, and the alcoholic beverage forming apparatus is configured to supply the alcoholic beverage mixture through an outlet of the mixing manifold to an interior of a beverage capsule held in the capsule holder during use of the alcoholic beverage forming apparatus such that the alcoholic beverage mixture may mix with the flavor medium contained in the interior of the beverage capsule to form an alcoholic beverage that may be dispensed from the dispenser of the alcoholic beverage forming apparatus.

DETAILED DESCRIPTION

Figure 1:
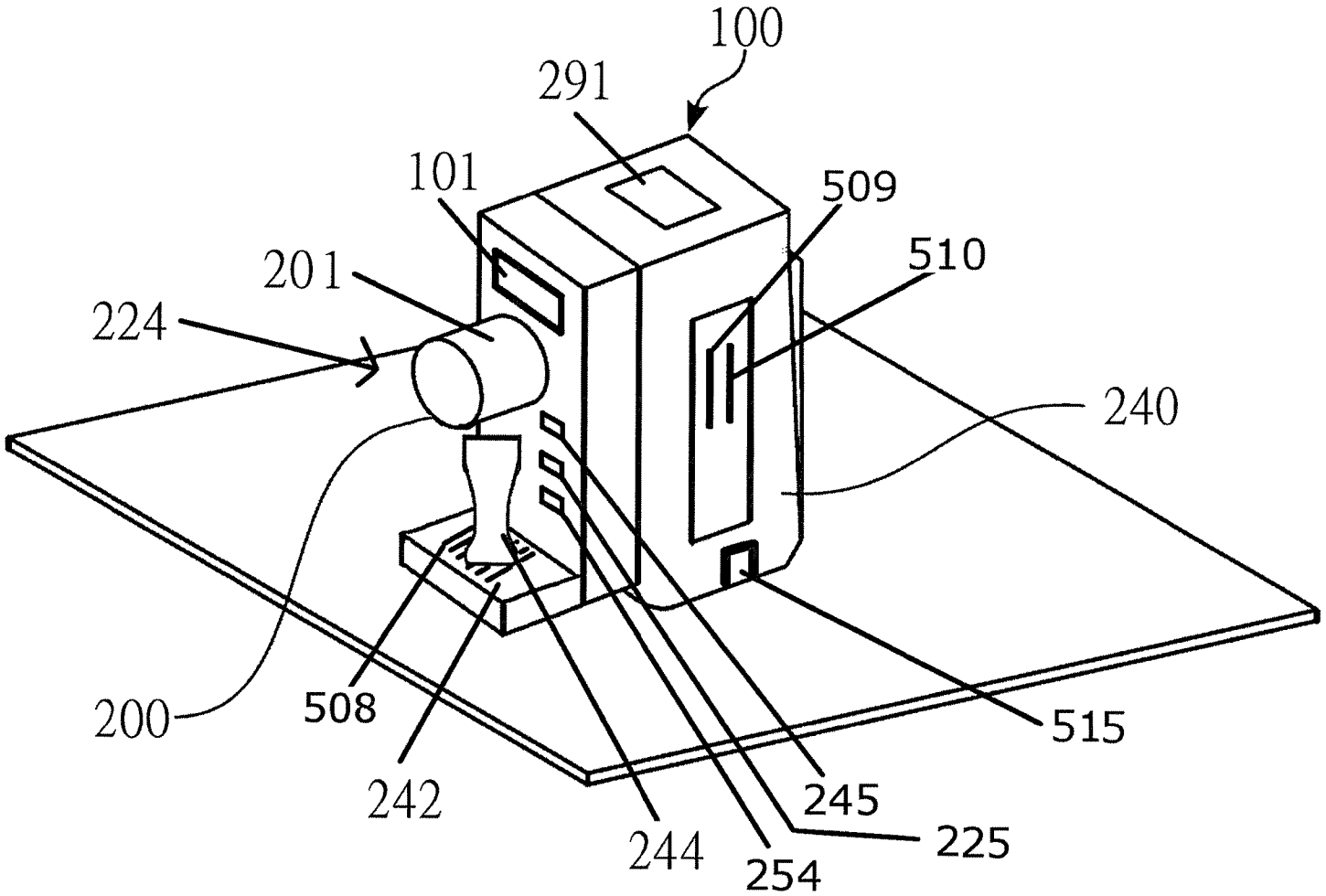
FIG. 1 is an illustration of an alcoholic beverage forming apparatus operable to form an alcoholic beverage using a capsule containing a flavor medium therein according to an embodiment as disclosed herein.

Disclosed herein is an alcoholic beverage forming apparatus operable to dispense an alcoholic beverage having a desired flavor, proof, temperature, and volume by mixing water and potable alcohol (alcohol) with a flavor medium disposed in a beverage capsule, such that the water and alcohol, which are supplied at predetermined temperatures, mix with the flavor medium to form an alcoholic beverage having a desired taste that may be dispensed from the alcoholic beverage forming apparatus. The alcoholic beverage forming apparatus may be operable to provide carbonated water from a carbonated water source such that a dispensed alcoholic beverage may have a desired level of carbonation.

The potable alcohol supplied by the alcoholic beverage forming apparatus may be any potable alcohol such as ethanol, unflavored or neutral vodka, rum, tequila, flavored vodka or the like. In an embodiment, the alcoholic beverage forming apparatus can include a single alcohol source that includes a single type of potable alcohol therein. For example, the alcoholic beverage forming apparatus preferably includes a single alcohol source of unflavored or neutral vodka. Alternatively, the single alcohol source may include more than one type of potable alcohol therein, such as a mixture of, for example, tequila and rum. In an embodiment, the alcoholic beverage forming apparatus can include multiple sources of alcohol, such as a tequila source for making flavored alcoholic beverages based on tequila, a flavored or unflavored vodka source for making alcoholic beverages based on vodka, and/or a rum source for making flavored alcoholic beverages based on rum. In this embodiment, the alcoholic beverage making apparatus may be operable to mix the alcohol from the multiple alcohol sources such that, for example, the alcoholic beverage making apparatus may form a mixed drink having multiple types of alcohol therein, such as, for example, a long island iced tea. In an embodiment, the alcoholic beverage forming apparatus may be configured to receive only certain types of alcohol.

In an embodiment, the water and alcohol sources are kept at both ambient and chilled temperatures such that they may be mixed, for example, in a mixing manifold of the alcoholic beverage forming apparatus to form an alcoholic beverage mixture having a desired temperature, proof, and volume such that the temperature, proof, and volume of an alcoholic beverage dispensed from the alcoholic beverage forming apparatus may thereby be controlled.

To form an alcoholic beverage, the alcoholic beverage forming apparatus can include at least two fluid sources or streams, such as a water supply reservoir and an alcohol supply reservoir, that can respectively supply water and alcohol at a predetermined temperature to a mixing manifold of the alcoholic beverage forming apparatus. The mixing manifold is operable to mix predetermined amounts of the water and alcohol supplied thereto so as to form an alcoholic beverage mixture having a desired proof, temperature, and volume, and the alcoholic beverage forming apparatus is operable to supply the alcoholic beverage mixture to an interior of a beverage capsule during use of the alcoholic beverage forming apparatus such that the alcoholic beverage mixture may mix with a flavor medium contained in the interior of the beverage capsule to form an alcoholic beverage that may be dispensed from the dispenser of the alcoholic beverage forming apparatus.

In an embodiment, to form an alcoholic beverage, the alcoholic beverage forming apparatus can include at least four fluid sources or streams, which can supply, for example, ambient water, ambient alcohol, cold water, and cold alcohol. In a further embodiment, the alcoholic beverage forming apparatus can include an optional fifth fluid source of cold carbonated water. Preferably, fluids from the at least four fluid sources, preferably the five fluid sources, can be combined to achieve an alcoholic beverage mixture that may be injected at a desired temperature, proof, volume, and level of carbonation into a beverage capsule, held in a receptacle of the alcoholic beverage forming apparatus and containing a flavor medium in an interior space thereof such that the flavor medium can mix with the alcoholic beverage mixture and an alcoholic beverage having a desired taste may be dispensed from a dispenser of the alcoholic beverage forming apparatus into a glass, cup, or any other suitable storage or drinking vessel. In an embodiment, the alcoholic beverage forming apparatus 100 can include a mixer reservoir 518 (see FIG. 9) operable to supply a mixer to the mixing manifold of the alcoholic beverage forming apparatus to flavor the alcoholic beverage mixture before the alcoholic beverage mixture is delivered to an interior of a beverage capsule that contains a flavor medium therein. For example, the mixer reservoir may supply fruit juice and/or any other mixer to further flavor the alcoholic beverage formed by the alcoholic beverage forming apparatus to make a mixed drink. An air pump may be utilized to purge residual fluid from the beverage capsule, or a supply line that is in fluid communication with the beverage capsule.

Flavor perception of a consumable product is defined as the combined impression of specific aroma, taste and trigeminal compounds along with entities that evoke mouth feel impressions such as astringency, mouth coating, fullness, etc. Aroma compounds are volatiles that interact with olfactory receptors in the nose evoking a signal to the brain interpreted as smell, while the five basic tastes are elicited by interactions of tastants with specific taste receptors for salt, sweet, bitter, sour and umami tastes, respectively.

In general, out of the many hundreds of chemical entities that are found in natural products, especially those of agricultural origin that may also have been subjected to additional fermentation or prolonged storage, only an order of ten chemical entities may be responsible for aroma, taste and mouth feel. Isolation and chemical analysis techniques allow for the identification and quantification of flavor compounds out of the many hundreds that may be detected in a fermented and/or brewed alcoholic beverage.

A flavor that mimics the sensory attributes of a certain product by using the same or similar flavor relevant compounds of the natural product is called "nature craft identical" and the combination of chemical entities that mimic the natural product is called a "nature craft recombinant". Recombinants may be altered or new compounds added to compensate for flavor compounds that cannot be used because they are not generally recognized as safe (GRAS) or availability issues and to create new superior flavors. Through omissions or additions of certain compounds in our "recombinants", important interplays between aroma, flavor and mouthfeel impressions can be determined and used to create the best possible nature craft identical product as outlined in commonly-assigned U.S. Patent Application Publication No. 2014/0272019 and commonly-assigned U.S. Patent Application Publication No. 2014/0272006, the entire content of each of which is incorporated herein by this reference thereto. The recombinants can be used as constituents of a flavor medium that can be placed in the interior of respective beverage capsules and used to form alcoholic beverages from the alcoholic beverage forming apparatus, having a desired taste, as described herein.

As used herein, the term "flavor" refers to taste, aroma and sensation and is thus a mixture of tastants, aroma compounds and sensates. Thus, for example, in an embodiment wherein an alcoholic beverage is desired to have the flavor of beer, the flavor provides a mixture of tastants, aroma compounds and sensates that mimics those found in a traditionally brewed beer.

In addition, the use of flavor systems (i.e., flavor mediums) to form alcoholic beverages and/or alcoholic beverage concentrates allows for quick and easy customization of alcoholic beverages as compared to conventional beverages and manufacturing systems.

As used herein, the term "wine" describes any beverage formed by fermenting grapes and/or other fruits and vegetables.

As used herein, the term "beer" describes a beverage brewed by fermenting malt with yeast and flavoring with hops.

As used herein, the term "whiskey" describes a beverage made from fermented grain such as rye or barley, which can be aged or blended.

As used herein, the term "drinking vessel" describes any drinking container, cup, glass, or the like including, but not limited to shot glasses, wine glasses, such as standard wine glasses and dessert wine glasses, tumbler glasses, martini glasses, flutes, rocks glasses, Collins glasses, grappa glasses, glencairn whisky glass, pint glass, steins, mugs, sake cups tankards, Quaich, schooner, pilsner glass, snifters, margarita glasses, pitchers, growlers, and the like.

Figure 2:
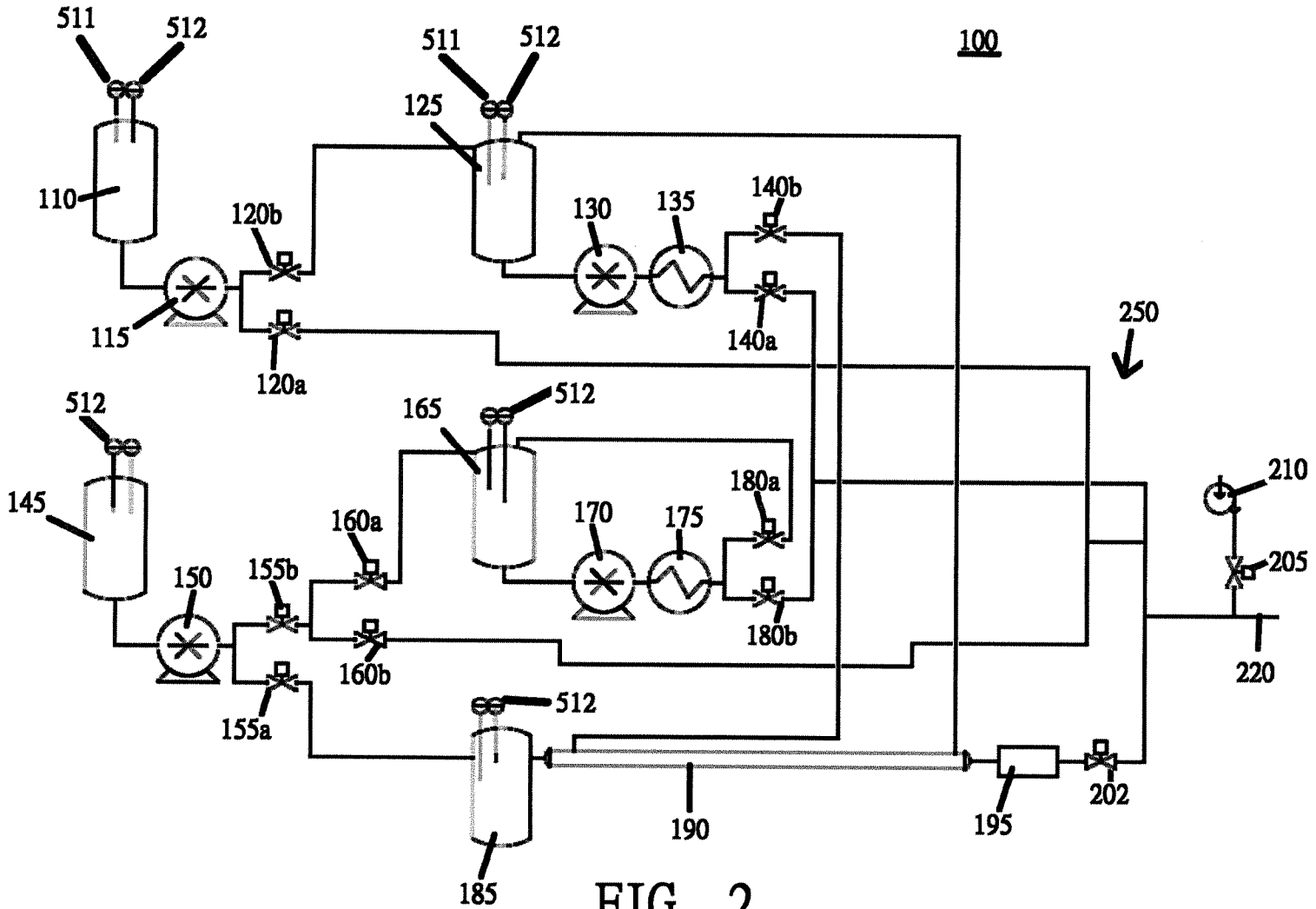
FIG. 2 is a schematic diagram of an alcoholic beverage forming apparatus according to an embodiment as disclosed herein.
Figure 3:
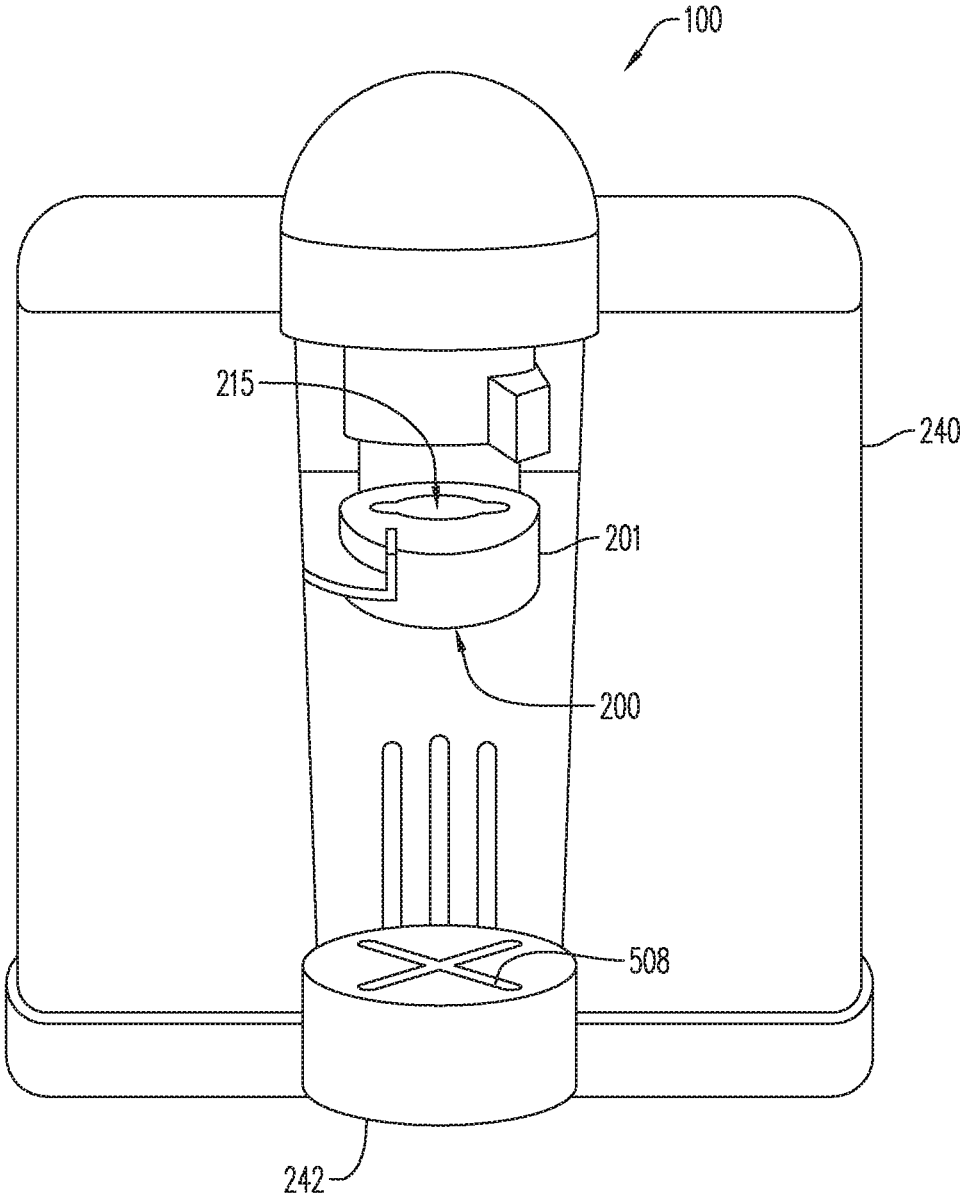
FIG. 3 is a front view of an alcoholic beverage forming apparatus for making individual alcoholic beverages according to an embodiment as disclosed herein.
Figure 4:
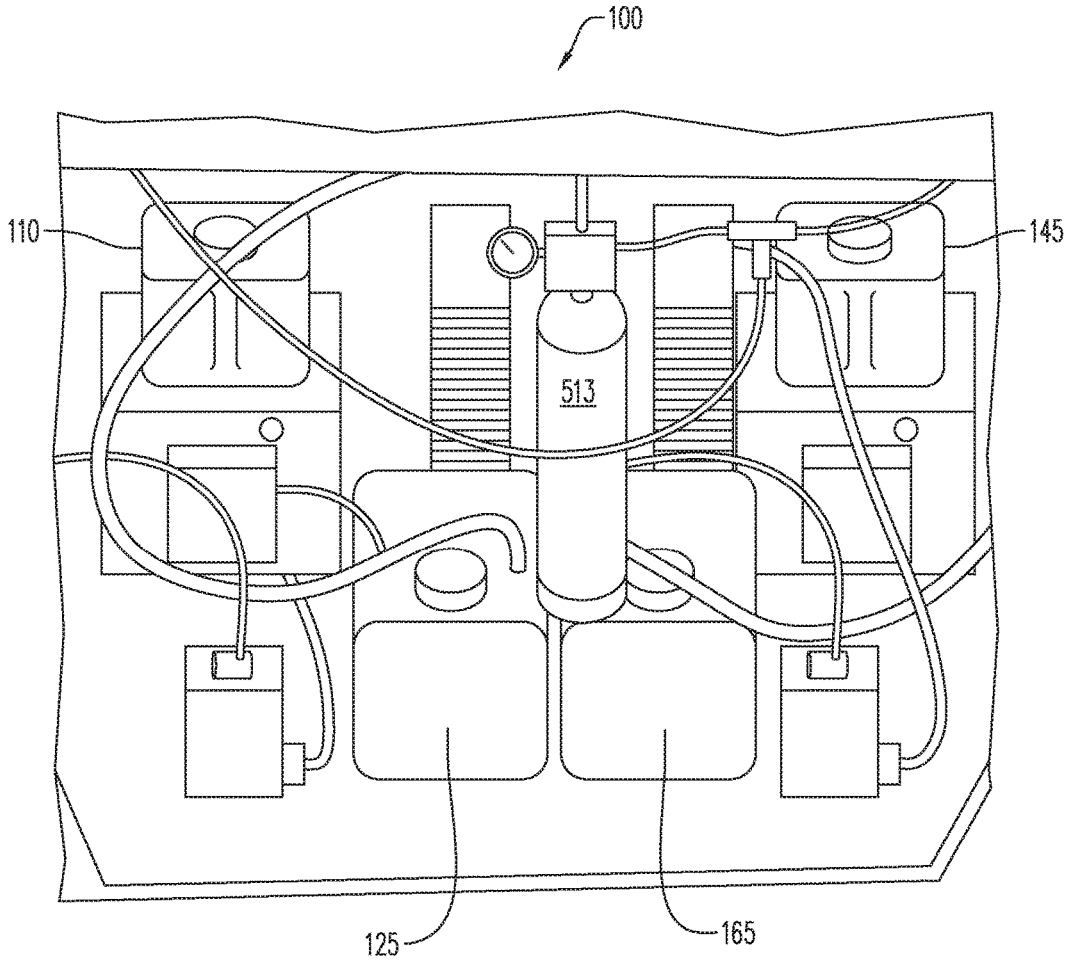
FIG. 4 is a back view of an alcoholic beverage forming apparatus for making individual alcoholic beverages according to an embodiment as disclosed herein.
Figure 5:
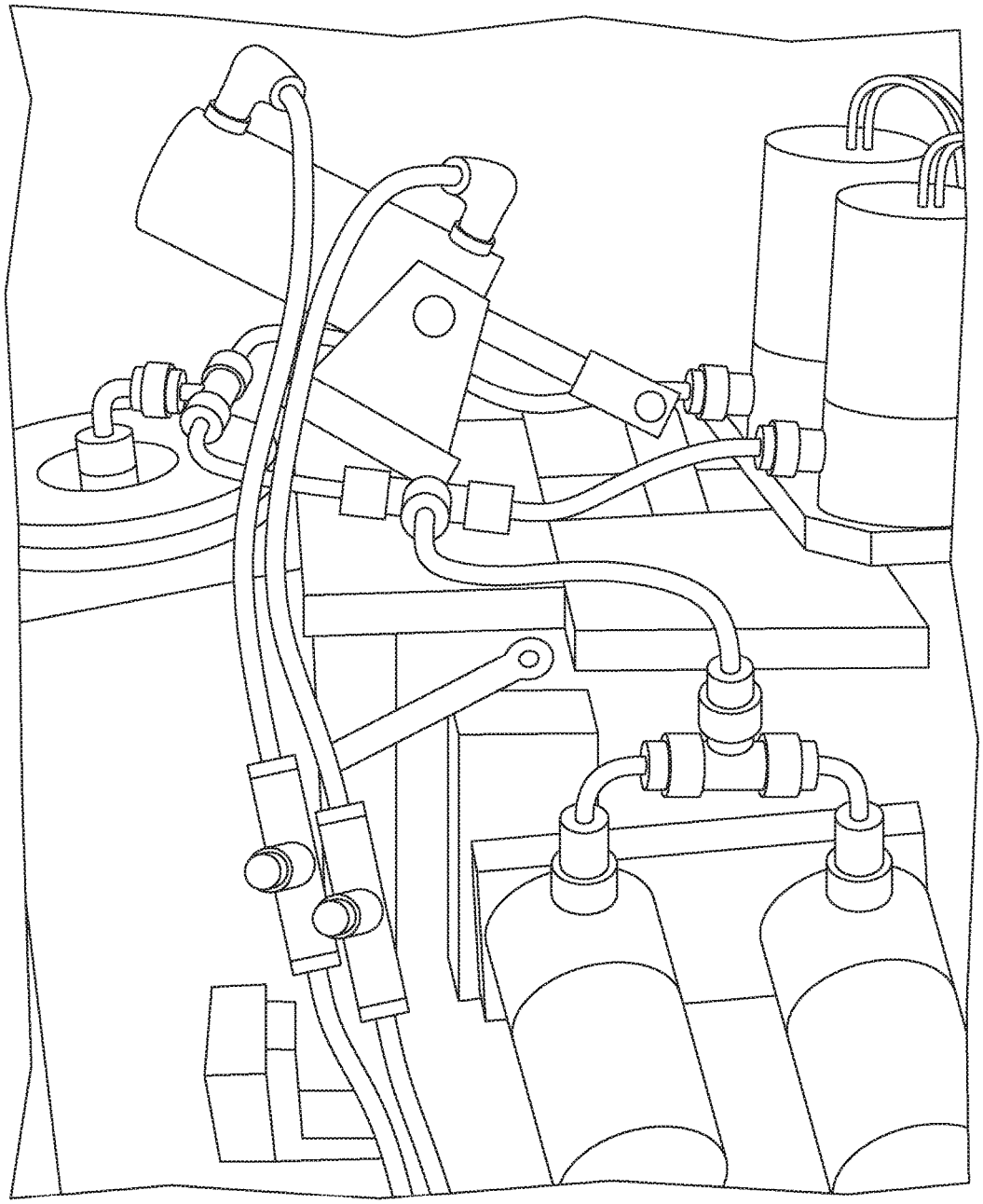
FIG. 5 is a perspective view of an inside of a dispensing head unit of an alcoholic beverage forming apparatus according to an embodiment as disclosed herein.

As shown in FIGS. 1, 3, 4, 5, 6, 7, and 9, an alcoholic beverage forming apparatus 100 for making and dispensing an alcoholic beverage is provided. The alcoholic beverage forming apparatus 100 is a capsule-based alcoholic beverage dispensing device operable to dispense an alcoholic beverage having a desired flavor, proof, temperature, level of carbonation, and volume by mixing water, alcohol, and optionally carbonated water with a flavor medium contained in a beverage capsule 20 (shown in FIG. 8). The alcoholic beverage forming apparatus 100 can include ambient and cold reservoirs for both water and alcohol sources. For example, as shown in FIG. 4, the alcoholic beverage forming apparatus can include ambient alcohol supply reservoir or source (AASR) 110, a cold alcohol supply reservoir or source (CASR) 125, an ambient water supply reservoir or source (AWSR) 145, and a cold water supply reservoir or source (CWSR) 165, and an optional carbonated water reservoir 185 (see FIG. 2) and replaceable pressurized gas canister 513 operable to carbonate the water in the carbonated water reservoir 185. Any potable alcohol may be used as the alcohol of the alcohol source such as but not limited to unflavored or neutral vodka, ethanol, rum, flavored vodka, tequila, or the like. Preferably, the alcohol of the alcohol source is an aqueous alcohol such as neutral or unflavored vodka or an ethanol and water mixture.

In an embodiment, the alcoholic beverage forming apparatus 100 can include multiple sources of alcohol such that the alcoholic beverage forming apparatus 100 is operable to supply, for example, tequila for tequila based alcoholic beverages and rum for rum based alcoholic beverages. In an embodiment, the alcoholic beverage forming apparatus 100 may be operable to mix the multiple sources of alcohol, or alternatively, the alcoholic beverage forming apparatus 100 may include two or more types of alcohol mixed in a single reservoir. The alcoholic beverage forming apparatus 100 can include a recognition system, such as a sensor disposed in a reservoir thereof that is operable to determine what kind of alcohol is in the respective reservoir of the alcoholic beverage forming apparatus 100. In an embodiment, the recognition system may include a scan-able bar code, or alternatively, an adult consumer can manually input the type of alcohol into an adult consumer interface (interface) of the alcoholic beverage forming apparatus 100 with, for example, a punch code.

In an embodiment, instead of an ambient or cold water reservoir, a water line could be used to supply water at ambient or cold temperatures, or a first water line could be used to supply water at ambient temperatures and a second water line could be used to supply water at cold temperatures.

The alcoholic beverage forming apparatus 100 for making an alcoholic beverage includes a housing 240 which houses the mechanical and electronic components of the alcoholic beverage forming apparatus 100. The alcoholic beverage forming apparatus 100 includes a dispensing head unit 224 including a capsule holder 201, which can receive, seal, and puncture or otherwise access the contents of the beverage capsule 20. The alcoholic beverage forming apparatus 100 may be operable to puncture an upper or side surface of the beverage capsule 20 such that an alcoholic beverage mixture may be injected into an interior or the beverage capsule 20. Additionally, the alcoholic beverage forming apparatus may be operable to puncture a side or bottom surface of the beverage capsule 20 such that the alcoholic beverage mixture and the flavor medium of the beverage capsule 20 may be dispensed therefrom.

In an embodiment, the alcoholic beverage forming apparatus 100 may be operable to control the inflow of the alcoholic beverage mixture (i.e. the water and alcohol) to the interior of the beverage capsule 20 so as to increase the mixing between the flavor medium and the alcoholic beverage mixture. For example, water and alcohol may be sequentially injected into the interior of the beverage capsule 20, or water and alcohol may be simultaneously injected into the interior of the beverage capsule. The alcoholic beverage mixture may be injected into the interior of the beverage capsule 20 at continuous variable rates, or alternatively the alcoholic beverage mixture may be injected into the interior of the beverage capsule 20 in a pulsed manner between an on flow and an off flow so as to facilitate mixing between the flavor medium and the alcoholic beverage mixer. Further, the capsule holder 201 can be a vibrate-able capsule holder that is operable to vibrate the beverage capsule 20 so as to increase the mixing between the flavor medium and the alcoholic beverage.

Figure 6:
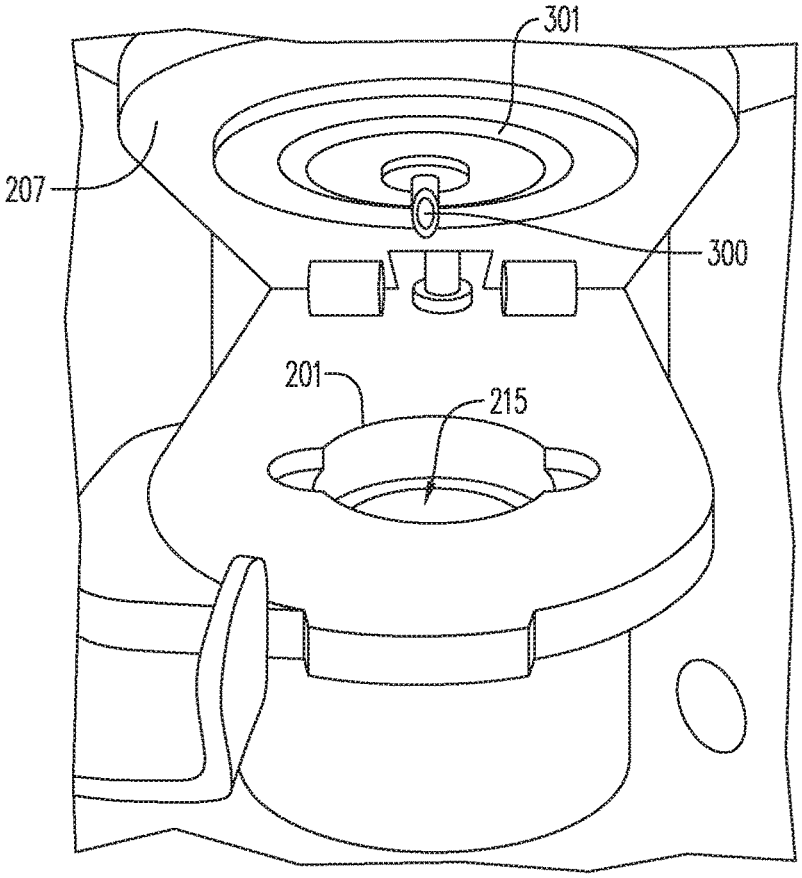
FIG. 6 is a perspective view of a capsule holder of an alcoholic beverage forming apparatus according to an embodiment as disclosed herein.
Figure 7:
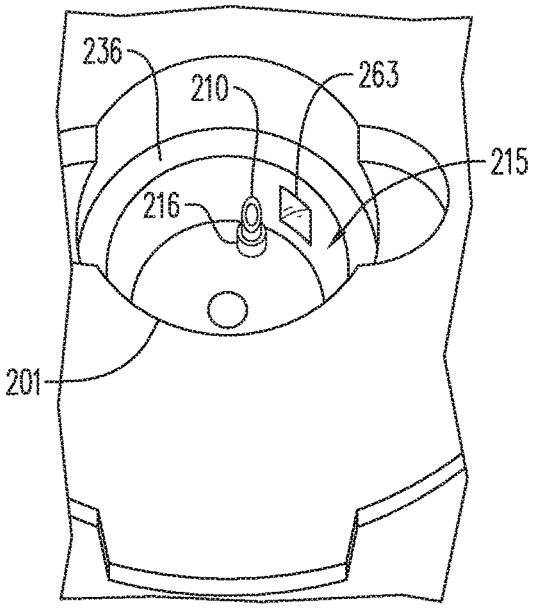
FIG. 7 is a perspective view of a capsule holder of an alcoholic beverage forming apparatus including a bottom hole punch mechanism according to an embodiment as disclosed herein.

FIGS. 3, 6, and 7 show details of an embodiment of a capsule holder 201. As shown in FIG. 6, the capsule holder 201 includes a receptacle 215 configured to receive a beverage capsule 20 and a lid portion 207 that is operable to close the receptacle 215 after the beverage capsule 20 has been inserted therein. The lid portion 207 includes a top hole punch 300, which may be a hollow needle or sharpened tube that can pierce a top portion of the capsule 20 and inject the alcoholic beverage mixture, and/or forced air into an interior of the beverage capsule 20. The lid portion 207 preferably includes an upper gasket 301 that is operable to form a liquid and/or gas tight seal when the lid portion 207 is lowered to close the receptacle 215 that contains the beverage capsule 20 therein. Preferably, the upper gasket 301 forms a liquid and/or gas tight seal against an upper surface of the beverage capsule 20 when the lid portion 207 closes the receptacle 215. Alternatively, the upper gasket 301 can be operable to form a liquid and/or gas tight seal against a rim 236 located in the receptacle 215 on which an outer flange of the beverage capsule 20 may be supported. In an alternative embodiment, the lid portion 207 may be fixed and the capsule holder 201 may lift to close and seal against the lid portion 207 and the upper gasket 301.

As shown in FIG. 7, the capsule holder 201 also includes a bottom hole punch 210 that is configured to form a hole in a bottom or side surface of the beverage capsule 20. The bottom hole punch 210 can be an automatic bottom hole punch, which can be operated on a delay (e.g., the bottom hole punch 210 can be configured to be raised so as to puncture a bottom surface of the beverage capsule after a predetermined amount of an alcoholic beverage mixture has been supplied to an interior of the beverage capsule). By operating the bottom hole punch on a delay, the alcoholic beverage forming apparatus 100 can provide for better mixing between the flavor medium in the interior of the beverage capsule 20 and the alcoholic beverage mixture supplied to the interior of the beverage capsule by the alcoholic beverage forming apparatus 100. Preferably, the bottom hole punch delay is programmed so that dispensing of the flavor medium and the alcoholic beverage mixture takes place before the alcoholic beverage forming apparatus 100 has supplied enough of the alcoholic beverage mixture to the interior of the beverage capsule 20 such that the beverage capsule 20 has reached fill capacity (i.e. the volume of the interior of the beverage capsule has been completely filled with fluid).

The bottom hole punch 210 can be a hollow needle or sharpened tube, and can include a lower gasket 216 that can form a liquid seal around a hole formed in the bottom or side surface of the beverage capsule 20 by the bottom hole punch 210. The bottom hole punch 210 can be inserted into the beverage capsule 20 at a predetermined time, such as before, during, or after the water and/or the alcohol (i.e. the alcoholic beverage mixture) is injected into the beverage capsule 20 via the top hole punch 300. In an embodiment, the bottom hole punch 210 can be operable to control the size of the hole formed in the bottom or side surface of the beverage capsule 20 so as to control the dispense rate of the alcoholic beverage which is dispensed therefrom. For example, the bottom hole punch 210 can be a conically shaped needle wherein the degree to which the bottom hole punch 210 is inserted into the bottom or side surface of the beverage capsule 20 can control the size of the hole formed thereby, and thus the mixing efficiency and dispense rate of the alcoholic beverage dispensed from the variably sized hole of the beverage capsule 20 may likewise be controlled.

The size of the variably sized hole can be adjusted so as to regulate the outflow speed (dispense rate) of the alcoholic beverage to facilitate mixing in the interior of the beverage capsule 20, and/or further mixing between the alcoholic beverage mixture and the flavor medium in the drinking vessel as the alcoholic beverage mixture and the flavor medium are dispensed from the beverage capsule 20. Alternatively, the beverage forming apparatus 100 may not include a bottom hole punch 210 wherein a capsule 20 disposed in the capsule holder 201 can be configured to open or rupture under pressure such that an alcoholic beverage may then be dispensed from the beverage capsule 20. In this embodiment, the alcoholic beverage forming apparatus 100 is operable to increase the pressure inside the beverage capsule 20 such that the increased pressure may cause the beverage capsule 20 to open.

In an embodiment, the capsule holder 201 may be operable to hold at least two beverage capsules 20 in the same dispensing head unit 224, or alternatively the alcoholic beverage forming apparatus can include multiple dispensing head units 224 which may each include a respective capsule holder 201 (see FIG. 9), such that alcoholic beverages having different flavors (i.e. tastes) may be sequentially or simultaneously formed by the alcoholic beverage forming apparatus 100. Alternatively, the alcoholic beverage forming apparatus 100 may be able to hold at least two beverage capsules 20 in the same dispensing head unit 224 of the alcoholic beverage forming apparatus 100 such that flavors of the respective beverage capsules 20 may be combined to form a single customizable alcoholic beverage. In an embodiment, if the capsule holder 201 of the dispensing head unit 224 of the alcoholic beverage forming apparatus 100 is only configured to hold a single beverage capsule 20 at a time, two or more beverage capsules 20 may be inserted sequentially into the capsule holder 201 by an adult consumer during beverage formation (e.g., while an alcoholic beverage is being dispensed) such that flavors of the individual beverage capsules 20 may be combined in a customizable alcoholic beverage formed by the alcoholic beverage forming apparatus 100. In this embodiment, multiple beverage capsules 20 may be bundled so as to allow for ease of separation and use of thereof.

Referring to FIGS. 1 and 3, the housing 240 can include an adjustable platform 242 that is designed to support a drinking vessel 244 as an alcoholic beverage is dispensed from the alcoholic beverage forming apparatus 100 via a dispenser 200. The adjustable platform 242 can be an automatically raiseable platform that can accommodate drinking vessels 244 of various heights and widths. Alternatively, an adult consumer could manually adjust the height of the adjustable platform 242. The drinking vessel 244 may be placed on the adjustable platform 242 and the location (height) of the adjustable platform 242 can be automatically adjusted such that an opening of the drinking vessel 244 is located under, or immediately adjacent and/or surrounding an outlet of the dispenser 200 so as to prevent spilling or splashing of an alcoholic beverage as it is dispensed from the alcoholic beverage forming apparatus 100. The alcoholic beverage forming apparatus preferably includes a drain 508 below the dispenser 200. For example, as shown in FIG. 1, the platform 242 includes a drain 508 in case any of an alcoholic beverage is spilled during dispensing thereof or by an adult consumer as the adult consumer removes the drinking vessel 244 from the platform 242.

Additionally, the housing 240 of the alcoholic beverage forming apparatus 100 can include a drinking vessel position sensor 245 that is operable to detect if a drinking vessel 244 becomes too close to the dispenser 200 or the receptacle 215 so as to prevent glass breakage, which could occur if the drinking vessel 244 is inadvertently raised into the dispenser 200 or capsule holder 201 of the alcoholic beverage forming apparatus 100. The drinking vessel position sensor 245, may also be configured such that the location of an upper rim of a drinking vessel of any size can be automatically located just under, or immediately adjacent and/or surrounding the outlet of the dispenser 200 so as to prevent spilling or splashing of an alcoholic beverage as it is dispensed from the alcoholic beverage forming apparatus 100.

In an alternate embodiment, the dispenser 200 may be an adjustable dispenser which is configured to locate an opening of the dispenser 200 just above or adjacent and/or surrounded by an opening of a drinking vessel 244 which is located below the dispenser 200. In this embodiment, the drinking vessel position sensor 245 is configured to detect if the dispenser 200 becomes too close to a drinking vessel 244 which is located below the dispenser 200. In an embodiment, the adjustable dispenser is automatically adjustable and the drinking vessel position sensor 245 is operable to sense the location of an opening of a drinking vessel 244 that is below the dispenser 200 during use of the alcoholic beverage forming apparatus such that the opening of the dispenser 200 may be automatically located just above or adjacent and/or surrounded by an opening of the drinking vessel during use of the alcoholic beverage forming apparatus.

In an embodiment, the alcoholic beverage forming apparatus 100 can include a fill level sensor 225 operable to determine the level of an alcoholic beverage that has been dispensed into a drinking vessel relative to the location of a rim (opening) of the drinking vessel. The fill level sensor 225 is operable to stop the alcoholic beverage forming apparatus 100 from further dispensing the alcoholic beverage when the top of the alcoholic beverage reaches the rim, or has filled the drinking vessel to a predetermined level. In this manner, a drinking vessel will not be overfilled and spillage may be reduced when an adult consumer, for example, places excessive amounts of ice in the drinking vessel or other liquids (i.e. mixers) in the drinking vessel.

Figure 9:
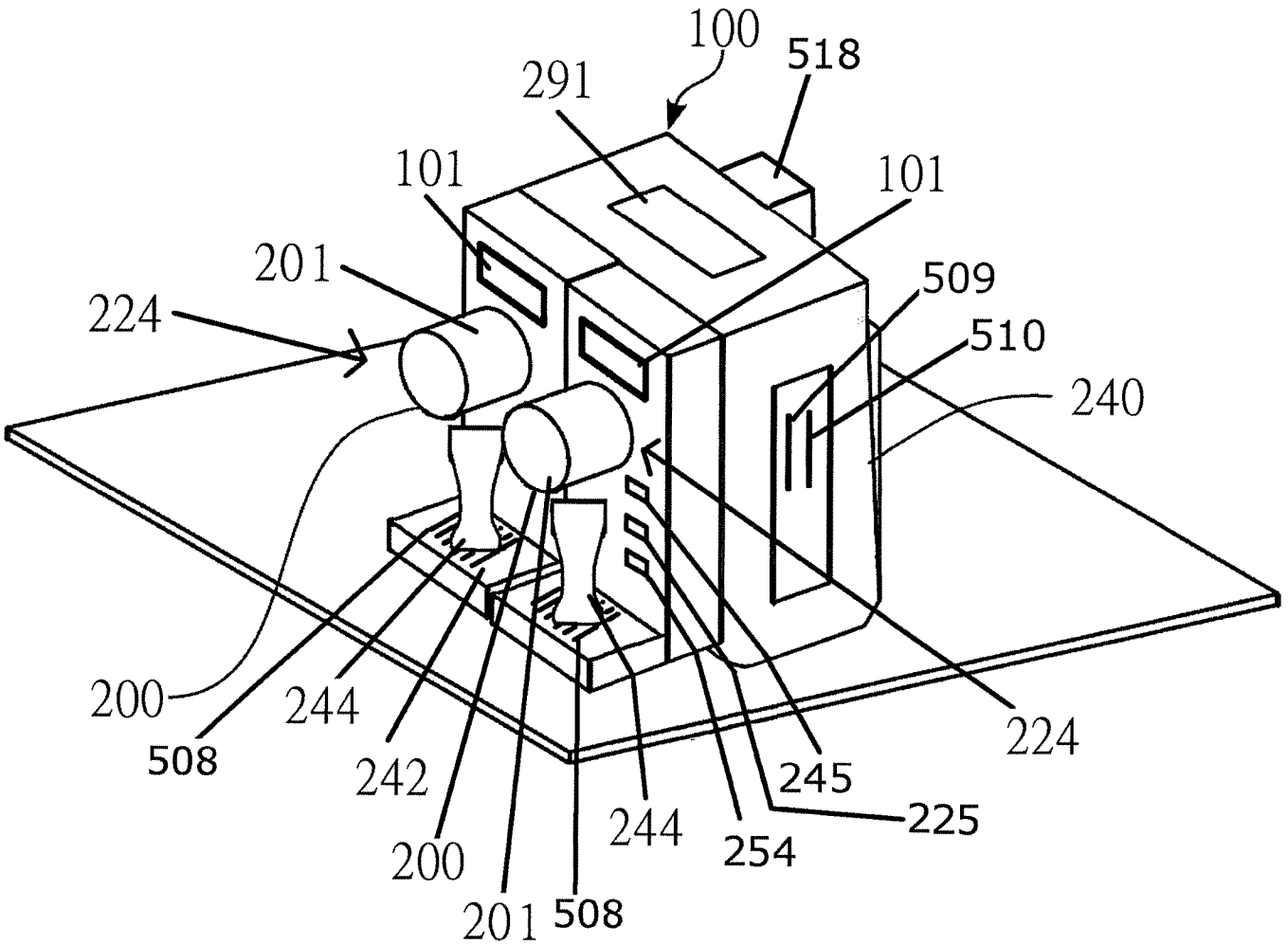
FIG. 9 is an illustration of an alcoholic beverage forming apparatus operable to form multiple alcoholic beverages using respective capsules each containing a flavor medium therein according to an embodiment as disclosed herein.

In an embodiment as shown in FIG. 9, the alcoholic beverage forming apparatus 100 could include multiple dispensers 200 to dispense multiple alcoholic beverages simultaneously or at different times. In an embodiment, if multiple dispensers 200 are used, each of the multiple dispensers can be used to dispense a specific type of beverage to prevent contamination or crossover of a dispensed beverage with residue from a previously dispensed beverage. Moreover, the alcoholic beverage forming apparatus 100 could include multiple adjustable platforms 242 adjacent each of the multiple dispensers 200 operable to each locate respective drinking vessels 244 of different sizes just under or immediately adjacent and/or surrounding respective outlets of the respective dispensers 200 so as to prevent spilling or splashing of an alcoholic beverage as it is dispensed. The alcoholic beverage forming apparatus 100 can include multiple dispensing head units 224 each including a capsule holder 201, which can receive, seal, and puncture or otherwise access the contents of a respective beverage capsule 20.

The alcoholic beverage forming apparatus 100 can also include a controller 291 such as a programmable logic controller, a compact logic controller, or any embedded controller of the like operable to control the alcoholic beverage forming apparatus 100 and an adult consumer interface (interface) 101 (shown in FIG. 1) or multiple adult consumer interfaces 101 (shown in FIG. 9) that are in electrical communication with the controller 291. The interface 101 allows an adult consumer to input desired beverage parameters including the desired proof, temperature, volume, amount of carbonation, and mixing pattern of the drink and other functions. The interface 101 may also allow an adult consumer to select from different alcohol types to be dispensed from the alcoholic beverage forming apparatus 100 if the alcoholic beverage forming apparatus 100 includes multiple alcohol reservoirs or sources that each include a respective type of alcohol, such as among an unflavored or neutral vodka reservoir, a flavored vodka reservoir, a rum reservoir, and a tequila reservoir.

The interface 101 can include a touch screen or buttons for input of information by an adult consumer. In an embodiment, the interface 101 can include wireless and/or Bluetooth functionality and can be synchronized with and/or controlled by an adult consumer's smart phone or other computing device or a remote control. The interface 101 can allow an adult consumer to input information related to one order or to input information to be saved for future drink orders. Additionally, the interface 101 can display the amount of calories in an alcoholic beverage to be formed and/or just formed by the alcoholic beverage forming apparatus 100.

The alcoholic beverage forming apparatus 100 can include parental controls, such as an ID reader operable 509 to verify the age of an adult consumer. The alcoholic beverage forming apparatus can also include a credit card reader 510, or may be configured to receive another form of electronic payment, such that an adult consumer can pay with a credit card, an electronic wallet, a hotel or cruise ship room key, or the like.

The alcoholic beverage forming apparatus 100 can also include a power supply operable to provide power to the alcoholic beverage forming apparatus 100 during use. The power supply can be a portable power supply 515 (see FIG. 1) that includes a battery, or an AC adapter that can be plugged into a wall outlet.

FIG. 2 is a schematic diagram of an embodiment of an alcoholic beverage forming apparatus. As shown in the schematic diagram, the alcoholic beverage forming apparatus 100 can include fluid sources such as an ambient alcohol supply reservoir or source (AASR) 110 operable to supply ambient alcohol to a mixing manifold 250 of the alcoholic beverage forming apparatus, a cold alcohol supply reservoir or source (CASR) 125 operable to supply cold alcohol to the mixing manifold 250 of the alcoholic beverage forming apparatus, an ambient water supply reservoir or source (AWSR) 145 operable to supply ambient water to the mixing manifold 250 of the alcoholic beverage forming apparatus, and a cold water supply reservoir or source (CWSR) 165 operable to supply cold water to the mixing manifold 250 of the alcoholic beverage forming apparatus. The supplies of ambient alcohol, cold alcohol, ambient water, and cold water may be mixed in the mixing manifold 250 of the alcoholic beverage forming apparatus 100 so as to form an alcoholic beverage mixture having a desired temperature, proof, and volume. In an embodiment, the reservoirs 110, 125, 145, and/or 165 may be replaced with supply lines which are respectively connected to an outside source. The alcoholic beverage forming apparatus 100 can also include an optional water carbonator or carbonated water reservoir or source (CWR) 185 operable to supply carbonated water to the mixing manifold 250 such that the alcoholic beverage mixture may be carbonated. Preferably, a heat exchanger 190 surrounds a supply line which supplies the carbonated water such that the carbonated water in the CWR 185 may be cooled to a desired temperature. The heat exchanger 190 can be a tubular heat exchanger which surrounds the supply line.

In an embodiment, the alcoholic beverage forming apparatus 100 includes one or more metering pumps operable to pump predetermined amounts of water and alcohol from the water and alcohol sources, and preferably predetermined amounts of ambient or cold alcohol or water from the respective fluid reservoirs or sources to the mixing manifold 250 such that the predetermined amounts may be mixed to form an alcoholic beverage mixture that is combined with a flavor medium and dispensed from the alcoholic beverage forming apparatus. For example, the alcoholic beverage forming apparatus 100 preferably includes an AASR metering pump 115 operable to pump a predetermined amount of ambient alcohol from the AASR 110, a CASR metering pump 130 operable to pump a predetermined amount of cold alcohol from the CASR 125, an AWSR metering pump 150 operable to pump a predetermined amount of ambient water from the AWSR 145, a CWSR metering pump 170 operable to pump a predetermined amount of cold water from the CWSR 165, and a flow meter 195 operable to allow a predetermined amount of carbonated water to be flown from the CWR 185.

The CASR 125 can be associated with a peltier, refrigerant, or thermoelectric alcohol chiller 135 that is operable to cool the alcohol in the CASR 125 or alternatively the chiller 135 can chill the alcohol in a supply line upstream of the mixing manifold before the alcohol is supplied to the mixing manifold. The CWSR 165 can also be associated with a peltier, refrigerant, or thermoelectric water chiller 175 that is operable to cool the water in the CWSR 165 or alternatively the chiller 175 can chill the water in a supply line upstream of the mixing manifold before the alcohol is supplied to the mixing manifold. Preferably, while the alcoholic beverage forming apparatus 100 is in an idle state, (e.g., when the alcoholic beverage forming apparatus is not dispensing an alcoholic beverage) alcohol in the CASR 125 and cold water in the CWSR 165 are cycled through the respective alcohol and water chillers 135, 175 such that the alcohol in the CASR 125 and the water in the CWSR 165 are maintained at a predetermined desired cold temperature. As defined in here, a predetermined desired cold temperature is a temperature which is at least less than the temperature of the water and alcohol in the respective AWSR 145 and AASR 110.

Preferably, the supply lines through which the cold water and the cold alcohol are cycled through are arranged adjacent a portion of a supply line leading to an outlet 220 of the mixing manifold 250 such that the cold water and cold alcohol can pre-chill the mixing manifold 250 and/or the portion of the supply line leading to the outlet 220, and also maintain the pre-chilled temperature (i.e. maintain the mixing manifold 250 at a constant temperature) of the mixing manifold 250 and the portion of the supply line leading to the outlet 220 so as to minimize heat transfer loss of the combined alcoholic beverage mixture that is dispensed through the outlet 220 to the mixing manifold 250 such that the temperature of the alcoholic beverage mixture may be controlled. The alcoholic beverage mixture which is mixed in the mixing manifold 250 is supplied to an interior of a respective beverage capsule through the outlet 220.

In an embodiment, the CWR 185 of the alcoholic beverage forming apparatus 100 includes a replaceable pressurized gas canister 513 (see FIG. 4) operable to carbonate water in the CWR 185. The replaceable pressurized gas canister of the CWR 185 can house carbon dioxide. However, in an alternative embodiment, the replaceable pressurized gas canister of the CWR 185 can house nitrogen. Preferably, the amount of carbonation provided by the CWR 185 can be controlled depending on the preference of an adult consumer (e.g., low, medium, or high levels of carbonation) or depending on an alcoholic beverage recipe. For example, an adult consumer can input a desired level of carbonation into the interface 101 (shown in FIG. 1) and a controller 291 that communicates with the interface 101 can control the amount of carbonated water to be released from the CWR 185 and added to the alcoholic beverage mixture based on the adult consumer's input.

The alcoholic beverage forming apparatus 100 can also include an air pump 210 to purge residual fluid from an interior of the beverage capsule 20 during and/or after initiation of a beverage making cycle. An air line valve 205 preferably isolates the air pump 210 from the alcoholic beverage mixture as the alcoholic beverage mixture is being supplied to an interior of the beverage capsule 20 by the alcoholic beverage forming apparatus 100 such that the alcoholic beverage mixture does not flood the air pump 210 before air is being supplied to the interior of the beverage capsule 20.

The alcoholic beverage forming apparatus 100 preferably also includes a plurality of valves 120*a*, 120*b*, 140*a*, 140*b*, 155*a*, 155*b*, 160*a*, 160*b*, 180*a*, 180*b*, 202 to facilitate the cooling, mixing, cycling, and reservoir refilling. In an embodiment, the valves 120*a*, 120*b*, 140*a*, 140*b*, 155*a*, 155*b*, 160*a*, 160*b*, 180*a*, 180*b*, 202 can be solenoid valves.

In addition, the controller 291 of the beverage forming apparatus 100 (see FIG. 1), can communicate with sensors to monitor and control, fluid levels in each of the respective reservoirs 110, 125, 145, 165, 185, respective fluid temperatures in each of the respective reservoirs, the flow rate of fluid supplied from each of the respective reservoirs 110, 125, 145, 165, 185, the composition of the alcoholic beverage mixture based on a preloaded recipe, etc. In an embodiment, the controller 291 can communicate with respective sensors, for example an ABV sensor 511 included in the alcohol supply reservoir that is operable to sense the ABV of the alcohol in the alcohol supply, and preferably respective ABV sensors 511 (see FIG. 2) in the respective AASR 110 and CASR 125 such that the proof of a formed alcoholic beverage mixture may be accurately measured and controlled. An adult consumer interacts with the interface 101, which communicates adult consumer instructions to the controller 291.

Preferably, the housing 240 of the alcoholic beverage forming apparatus 100 can be formed of plastic, metal, and combinations thereof.

The alcoholic beverage forming apparatus 100 can be a compact, counter sized device or a larger device for use in restaurants, bars, airplanes, cruise ships, or other establishments which serve beverages. For example, the alcoholic beverage forming apparatus 100 can be sized for placement on a counter or the alcoholic beverage forming apparatus 100 can include a support stand such that the alcoholic beverage forming apparatus is independently supported.

The water supply reservoir preferably includes a temperature sensor operable to measure the temperature of the water in the water supply reservoir. Preferably both the ambient and the cold water supply reservoirs 145, 165 include respective temperature sensors 512 (see FIG. 2). The alcohol supply reservoir can also include a temperature sensor operable to measure the temperature of the alcohol in the alcohol supply reservoir. Preferably, both the ambient and the cold alcohol supply reservoirs 110, 125 include respective temperature sensors 512 (see FIG. 2). Preferably, the carbonated water reservoir 185 includes a respective temperature sensor 512 operable to measure the temperature of the carbonated water in the carbonated water supply reservoir 185. Preferably, the controller 291 can communicate with the respective temperature sensors 512.

The alcoholic beverage forming apparatus 100 can preferably include a lighting and/or sound effects component 254 in electrical communication the controller 291 wherein the lighting and/or sound effects component 254 is operable to provide lighting and/or sound effects to enhance an adult consumer's experience and/or create ambiance when the alcoholic beverage forming apparatus is used. For example, an adult consumer may develop a negative perception of the alcoholic beverage prior to consumption of the alcoholic beverage because the adult consumer may perceive the alcoholic beverage to be a first color while the alcoholic beverage is dispensed in a stream from the dispenser 200, and may perceive a second color when the alcoholic beverage is fully dispensed into the drinking vessel. Thus, the deliberate use of lighting effects and colors provided by the lighting and/or sound effects component 254 can mask the first color perceived by the adult consumer, or alternatively, the deliberate use of lighting effects and colors may be used to shade the dispensed stream of the alcoholic beverage such that the first color perceived by the consumer matches the second color perceived by the adult consumer. The lighting and/or sound effects scheme provided by the lighting and/or sound effects component 254 may be predetermined based on a given alcoholic beverage recipe. The selection of sounds and/or colors can be congruent to the nature of an alcoholic beverage being dispensed by the alcoholic beverage forming apparatus 100. For example, using soft versus sharp sounds and similarly soft versus intense colors/lighting in accordance to the nature of a dispensed alcoholic beverage, i.e. a smooth versus sharp alcoholic beverage, may enhance the overall user experience.

Figure 8:
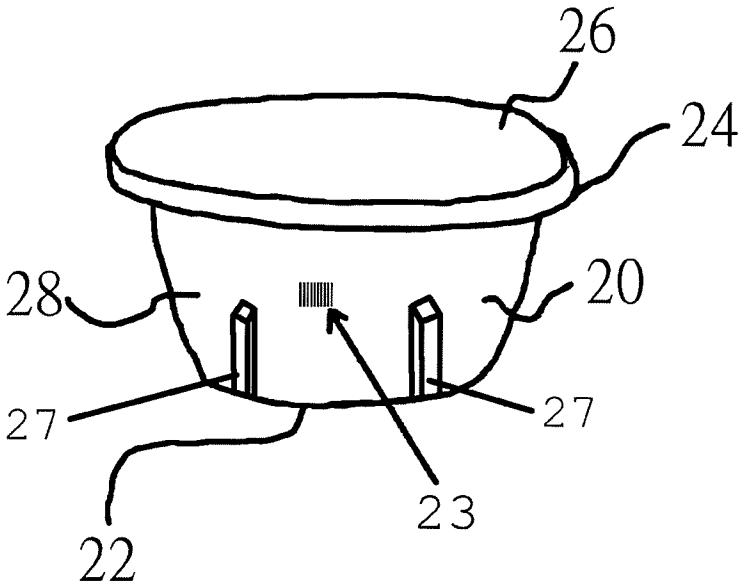
FIG. 8 is a perspective view of a capsule for use with an alcoholic beverage forming apparatus according to an embodiment as disclosed herein.

FIG. 8 illustrates an embodiment of a beverage capsule 20 that contains a flavor medium in an interior thereof that can be used with an alcoholic beverage forming apparatus 100 for making an alcoholic flavored beverage when placed in the receptacle 215 of the beverage capsule holder 201 of the alcoholic beverage forming apparatus 100. The flavor medium of the beverage capsule 20 is preferably in liquid form, however in alternate embodiments the flavor medium may be in powder or gel form. The beverage capsule 20 can be used to form a beverage having the taste and/or aroma of various types of beers, wines, and/or liquors including whiskeys and scotches. Moreover, the beverage capsule 20 can include a flavor medium that mimics a mixed alcoholic drink such as, but not limited to, a rum and cola. Additionally, custom made, branded, or creatively flavored alcoholic beverages that provide a unique or differentiated and customizable experience for adult consumers may be formed from the flavor medium of the beverage capsule 20, or alternatively from respective flavor mediums of multiple beverage capsules that may be combined to form an alcoholic beverage. As used herein "capsule" may also refer to capsules which are refillable and therefore reusable, or capsules which are disposable.

Preferably, the beverage capsule 20 can include the bottom wall 22, at least one sidewall 28, an outer flange (flange) 24 extending from the sidewall and a cover 26 that forms an upper surface of the beverage capsule 20 that is sealed to the flange 24 so as to maintain the flavor medium within the interior of the beverage capsule 20 before use. The bottom wall 22, sidewall 28 and flange 24 can be integrally formed of a plastic material or a metal material such as aluminum foil. The cover 26 can be formed of a plastic or foil material (e.g., aluminum foil). In an embodiment, the cover 26, and/or the integrally formed bottom wall 22, sidewall 28 and flange 24 are formed of a multi-laminate of plastic and foil materials. Preferably, the material or materials used to form the bottom wall 22 and the cover 26 are each capable of being pierced so as to allow liquids and/or gases to enter the beverage capsule 20 and pass therethrough. In embodiments, the bottom wall 22 can be formed of a thinner plastic material than the sidewall 28. In an alternate embodiment, the beverage capsule 20 can be configured to rupture after the interior of the beverage capsule 20 has been pressurized to a level sufficient to thereby cause a portion of the beverage capsule to open such that an alcoholic beverage may be dispensed through the opened portion of the beverage capsule 20 after the capsule has ruptured.

A 2D matrix (or barcode) 23 can be printed, embedded or otherwise affixed on a portion of the capsule 20. The 2D matrix (or barcode) 23 is read by a scanner 263 (see FIG. 7) positioned in or adjacent the capsule holder 201. The 2D data matrix (or barcode) 23 contains all of the necessary recipe information to make an alcoholic beverage corresponding to the flavor medium included in the beverage capsule 20, and the recipe information is fed into the controller 291. The 2D matrix (or barcode) 23 can also act as a security feature as the alcoholic beverage forming apparatus 100 can be programmed not to function if an inserted beverage capsule 20 does not include a compatible 2D matrix (or barcode) 23 information. In lieu of a barcode, a microchip could be used to provide the necessary information about the contents of the beverage capsule 20, or alternatively, a code on the beverage capsule 20 can be manually inputted into the interface 101 by an adult consumer.

The recipe information provided by the 2D matrix may include one of more of the following parameters including the recipe name and a number corresponding to the recipe, the volume of the flavor medium in the capsule, a final proof, a default beverage temperature, a final beverage volume, dispensing time, bottom hole punch delay time, a default glass height, whether the beverage is carbonated or not as well as the desired level of carbonation, a predetermined lighting and/or sound effects scheme, and additional options which may be presented to an adult consumer such as whether to add additional water, carbonation, or to change the final beverage temperature.

In addition, the beverage capsule 20 can optionally include one or more ridges 27 on the sidewall 28 of the beverage capsule 20. The ridges 27 can mate with depressions in the receptacle 215 of the capsule holder 201 to ensure the beverage capsule 20 is correctly positioned in the capsule holder 201 so as to ensure that the 2D matrix (or barcode) 23 can be read and the capsule holder 201 will securely close around the beverage capsule 20 and ensure proper opening of the capsule 20 during use.

Preferably, each beverage capsule 20 can be used to form a single serving alcoholic beverage. As used herein, the term "single serving" refers to an individual beverage serving having a size ranging from about 100 ml to about 1,500 ml (e.g., about 100 ml to about 1,200 ml, about 200 ml to about 1,000 ml, about 300 ml to about 800 ml, about 400 ml to about 700 ml or about 500 ml to about 600 ml).

As used herein, the term "flavor" refers to taste, aroma and sensation and is thus a mixture of tastants, aroma compounds and sensates ("e.g., mouthfeel). Thus, for example, the beverages formed herein which have the flavor of beer provide a mixture of tastants, aroma compounds and sensates that mimic those found in a traditionally brewed beer.

In an embodiment, the beverage capsule 20 can contain a flavor medium in a dry, semi-dry, or liquid form. The flavor medium can include powders, granules, flakes, beads and the like of the various flavor compounds. Alternatively, the flavor medium could be in the form of a semi-liquid or gel.

Also preferably, the flavor medium is an alcohol-free concentrate of beer, wine, liquor or a mixed drink. The flavor medium can be formed by conventional methods such as freeze drying, reverse osmosis and ultrafiltration as described in WO 99/27070 to Tripp, GB 2,261,442, DE 2145298, and U.S. Patent Application Publication No. 2010/0047386, the entire contents of each of which is incorporated herein by reference thereto.

As used herein, the term "flavor medium" describes one or more flavor compounds that are used in combination to create beverages having the flavor, mouthfeel and/or aromas of a wide variety of wines, beers, liquors, and/or mixed alcoholic beverages, but without the need for distillation, aging, fermentation, brewing and other costly and time consuming measures associated with the production of wine, beer and/or liquors.

The flavor medium can be altered by substituting or adding additional flavor compounds, as described herein, to the flavor medium. Thus, various flavor compounds can be combined to form a flavor medium which will provide the same flavors and/or aromas as conventionally brewed, distilled, aged and/or fermented beer, wine, liquor or mixed beverages. The flavor medium can be in liquid or dry form. Further, respective flavor mediums having different flavors, from multiple beverage capsules 20 may be combined to form a customizable alcoholic beverage.

Also preferably, flavor medium is included in the interior of the beverage capsule 20 in amount sufficient to form a single serving beverage having an alcohol content ranging from about 0.1% alcohol by volume to about 90% alcohol by volume. For example, wine can have an alcohol content of about 0.1% alcohol by volume to about 25% alcohol by volume, whiskey can have about 40% (or lower) alcohol by volume to about 70% alcohol by volume and beer can have about 2% alcohol by volume to about 20% alcohol by volume. The amount of alcohol concentrate can be selected based on the type of beverage being formed and/or can be controlled by the controller 291 of the alcoholic beverage forming apparatus 100 used to form the beverage if the adult consumer wishes to have a beverage having a lower alcohol content than that contemplated when forming the capsule 20. For example, a low alcohol or alcohol free beer can be dispensed from the alcoholic beverage forming apparatus 100 which has the flavor of a beer which may traditionally have a higher alcoholic content if traditionally brewed.

Preferably, the beverage capsule 20 is in the form of a bag, cup or box, which can be made of plastic, glass or other suitable materials. Also preferably, the material used to form the capsule 20 is biodegradable. Moreover, the material used to form a beverage capsule 20 is selected from suitable materials that possess low moisture and oxygen permeation and minimize the diffusion and uptake (scalping) of flavors from the flavor mixture and thus prolong the shelf life of the capsules.

Preferably, the beverage capsule 20 is sealed during manufacture of the beverage capsule 20.

In use, the beverage capsule 20 can be opened at one or more locations upon placement in and/or activation of the alcoholic beverage forming apparatus 100. Thus, the beverage capsule 20 includes one or more weakened areas which can be pierced, torn, ruptured, and/or removed by the alcoholic beverage forming apparatus 100 so as to release the flavor system upon activation of the alcoholic beverage forming apparatus 100.

In embodiments, the adult consumer can instruct the alcoholic beverage forming apparatus 100 to dispense less than or none of the alcohol so as to form a non-alcoholic beverage. In this instance, beverage capsules 20 can include a flavor medium that includes constituents which are configured to provide the flavor of the alcohol which is selected not to be supplied by an adult consumer of the alcoholic beverage forming apparatus. Thus, the taste of an alcoholic beverage may be maintained while the alcohol content thereof is reduced or eliminated entirely.

In embodiments, to start the operation of the alcoholic beverage forming apparatus 100, an adult consumer, bartender, or waiter can place the beverage capsule 20 including a flavor medium therein in the capsule holder 201 and close the cover 207 around the beverage capsule 20. The process of locking the beverage capsule 20 into the capsule holder 201 preferably forces a top punch 300 (See FIG. 6) to puncture the top (cover) 26 of the capsule 20. Alternatively, the top punch 300 may be subsequently lowered to puncture the cover 26 of the capsule after the capsule has been locked into the capsule holder 201.

The 2D matrix (or barcode) 23 on the capsule 20 is read by the scanner positioned in or adjacent the capsule holder 201, and all of the necessary recipe information to make the beverage corresponding to the flavor medium included in the capsule 20 is fed into the controller 291. In an embodiment, based on the recipe, the alcoholic beverage may be automatically dispensed with no further action by an adult consumer.

Alternatively, the adult consumer may then activate the alcoholic beverage forming apparatus 100 using the interface 101, if an automatic beverage cycle is not activated, and the adult consumer may then await dispensing of the alcoholic beverage. Water from the water supply or supplies and alcohol from the alcohol supply or supplies, optional carbonated water from the carbonated water supply, and pressurized gas from the pressurized gas source may be dispensed simultaneously or in series to the mixing manifold 250 to form an alcoholic beverage mixture wherein the alcoholic beverage mixture is then mixed with the flavor medium. Preferably, the alcoholic beverage mixture is mixed with the flavor medium in the interior of the beverage capsule 20, however alternatively, the alcoholic beverage mixture may partially mix with the flavor medium wherein the force of the dispensed alcoholic beverage mixture and flavor medium as they are dispensed from the beverage capsule 20 may facilitate further mixing therebetween in the drinking vessel as the fluid constituents are dispensed. In an embodiment, the dispensing head unit 224 is operable to vibrate or agitate the beverage capsule 20 in the capsule holder 201 to further facilitate mixing between the alcoholic beverage mixture and the flavor medium. For example, the capsule holder 201 can be a vibrate-able capsule holder that vibrates or agitates a beverage capsule 20 included therein when the alcoholic beverage mixture is injected into the beverage capsule 20 and/or when the alcoholic beverage mixture and flavor medium are dispensed from the beverage capsule 20. Embodiments of flavor mediums can be found in commonly-assigned U.S. Patent Application Publication No. 2016/0073673, which is hereby incorporated herein by reference in its entirety.

The controller 291 receives the recipe parameters and sends the name of the beverage and the adult consumer defined options (if any) to the interface 101 for display to an adult consumer such as an adult customer, bartender, or waiter. The adult consumer chooses option (if available), places the glass, cup, or drinking vessel, on the glass platform 242 and initiates the alcoholic beverage forming apparatus 100 to make the alcoholic beverage (i.e., a beverage forming cycle). Based on the recipe parameters, the controller 291 reads the current temperature of each of the five fluid streams (ambient water, ambient alcohol, cold water, cold carbonated water, and cold alcohol) and calculates the correct proportions of each that will be mixed to form the final alcoholic beverage having a desired proof, temperature, volume, and carbonation of the alcoholic beverage mixture dictated by the recipe and adult consumer inputted options. The recipe parameters may also include the option to reduce the sugar content of an alcoholic beverage formed by the alcoholic beverage forming apparatus 100. Based on the default glass height, the glass platform raises the glass to a position directly underneath the capsule holder. The drinking vessel position sensor 245 is present to prevent glass breakage if a taller glass than the default is present. In an embodiment, the drinking vessel position sensor 245 may also detect if the glass is shorter than the default height, wherein the glass platform may be raised such that spilling and/or splashing of the beverage is reduced while the beverage is being dispensed by the alcoholic beverage forming apparatus.

The controller 291 sends the correct speed to each pump (or flow meter in the case of carbonated water) and the pumps turn on at the specified flow rate for the dispensing time, or alternatively, the proper valves (e.g. solenoid valves) open until the total predetermined volume is achieved. The fluids combine in the mixing manifold and the combined alcoholic beverage mixture at the predetermined temperature and proof is injected into the interior of the beverage capsule wherein the flavor medium mixes with the alcoholic beverage mixture and/or dissolves in the alcoholic beverage mixture to form an alcoholic beverage. After a predetermined bottom hole punch delay time, a bottom hole punch is driven into the bottom of the beverage capsule wherein the beverage is dispensed into the glass or drinking vessel from the capsule. After the full volume of the combined fluid stream is injected into and/or through the beverage capsule, an air pump may be turned on wherein air is forced through the capsule to eject any residual fluid remaining in the capsule into the glass. The bottom hole punch then disengages from the capsule and the glass platform is lowered into its idle position. The interface 101 informs the adult consumer that the beverage is complete, wherein the adult consumer may remove the empty capsule from the capsule holder. During dispensing the lighting and/or sound effects component may provide lighting and/or sound effects.

When the alcoholic beverage forming apparatus is in an idle state, pumps preferably circulate the cold alcohol and water supply, and the cold water supply into and out of their respective reservoirs through a chiller. While idle, the alcoholic beverage forming apparatus 100 preferably monitors the fluid levels in the chilled reservoirs, refills the reservoirs from the ambient reservoirs which are in fluid communication with each other if the fluid reservoirs are low. Water in the chilled carbonation reservoir is kept under constant pressure by a carbon dioxide canister. The carbonated water in the carbonation reservoir is preferably chilled with a tube heat exchanger surrounding a supply line or alternatively a refrigerant based chiller in a water bath. The carbonation reservoir may be automatically refilled from a pre-chilled water loop which is supplied from the ambient water reservoir.

In this specification, the word "about" is often used in connection with numerical values to indicate that mathematical precision of such values is not intended. Accordingly, it is intended that where "about" is used with a numerical value, a tolerance of ±10% is contemplated for that numerical value.

While the foregoing describes in detail a method and apparatus for forming an alcoholic beverage with reference to a specific embodiment thereof, it will be apparent to one skilled in the art that various changes and modifications and equivalents to the apparatus and method may be employed, which do not materially depart from the spirit and scope of the embodiments disclosed herein.

We claim:

1. An alcoholic beverage forming apparatus operable to dispense an alcoholic beverage, the alcoholic beverage forming apparatus comprising:

a capsule holder configured to receive a beverage capsule having a flavor medium in an interior thereof;

a water supply reservoir operable to supply water to a mixing manifold of the alcoholic beverage forming apparatus at a predetermined temperature;

an alcohol supply reservoir operable to supply alcohol to the mixing manifold of the alcoholic beverage forming apparatus at a predetermined temperature;

a dispenser operable to dispense the alcoholic beverage therefrom;

wherein predetermined amounts of the water and alcohol supplied to the mixing manifold are combined therein so as to form an alcoholic beverage mixture having a desired proof, temperature, and volume, and the alcoholic beverage forming apparatus is operable to supply the alcoholic beverage mixture through an outlet of the mixing manifold to an interior of the beverage capsule held in the capsule holder during use of the alcoholic beverage forming apparatus such that the alcoholic beverage mixture mixes with the flavor medium contained in the interior of the beverage capsule to form the alcoholic beverage that is dispensed from the dispenser of the alcoholic beverage forming apparatus;

a carbonated water reservoir operable to supply carbonated water to the mixing manifold of the alcoholic beverage forming apparatus to carbonate the alcoholic beverage; a consumer interface configured to receive consumer input information and a controller operable to control processes performed by the beverage forming apparatus, a data matrix scanner operable to read data of a matrix positioned on the beverage capsule containing the flavor medium wherein the data of the matrix includes recipe information for the alcoholic beverage; a lighting or sound effects component operable to provide lighting or sound effects during use of the alcoholic beverage forming apparatus; a portable power supply; a fill level sensor operable to determine a level of an alcoholic beverage that has been dispensed into a drinking vessel during operation of the alcoholic beverage forming apparatus wherein the fill level sensor is operable to stop the alcoholic beverage forming apparatus from further dispensing an alcoholic beverage if a dispensed alcoholic beverage reaches an upper opening of the drinking vessel or has filled the drinking vessel to a predetermined level; a drain below the dispenser; a mixer reservoir operable to supply a flavored mixer to the mixing manifold of the alcoholic beverage forming apparatus such that the alcoholic beverage mixture is combined with the flavored mixer in the mixing manifold to flavor the alcoholic beverage mixture before the alcoholic beverage mixture is delivered to an interior of a beverage capsule through the outlet of the mixing manifold; a credit card reader; an ID reader; and a recognition system operable to recognize the type of alcohol in the alcohol reservoir.

2. The alcoholic beverage forming apparatus of claim 1, wherein the alcohol supply reservoir includes an alcohol by volume sensor configured to measure the alcohol by volume of alcohol in the alcohol supply reservoir.

3. The alcoholic beverage forming apparatus of claim 1, wherein the alcoholic beverage forming apparatus includes a housing that houses mechanical and electronic components of the alcoholic beverage forming apparatus.

4. The alcoholic beverage forming apparatus of claim 3, wherein the housing houses the water supply reservoir and the alcohol supply reservoir.

5. The alcoholic beverage forming apparatus of claim 1, further comprising a platform located below the dispenser wherein the platform is configured to support a drinking vessel to which the alcoholic beverage is dispensed from the dispenser during operation of the alcoholic beverage forming apparatus.

6. The alcoholic beverage forming apparatus of claim 5, wherein the platform is an adjustable platform which is configured to locate an upper opening of a drinking vessel that is supported on the adjustable platform during use of the alcoholic beverage forming apparatus under an opening of the dispenser or adjacent and surrounding the opening of the dispenser.

7. The alcoholic beverage forming apparatus of claim 6, further including a drinking vessel position sensor that is configured to detect if the drinking vessel becomes too close to the dispenser or wherein the adjustable platform is automatically adjustable and the drinking vessel position sensor is operable to sense the location of the upper opening of the drinking vessel that is supported on the adjustable platform during use of the alcoholic beverage forming apparatus such that the upper opening of the drinking vessel is automatically located under the opening of the dispenser or adjacent and surrounding the opening of the dispenser during use of the alcoholic beverage.

8. The alcoholic beverage forming apparatus of claim 1, wherein the dispenser is an adjustable dispenser which is movable to locate an opening of the dispenser above an upper opening of a drinking vessel or adjacent and surrounded by the upper opening of the drinking vessel located below the dispenser.

9. The alcoholic beverage forming apparatus of claim 8, further including a drinking vessel position sensor that is configured to detect if the dispenser becomes too close to the drinking vessel located below the dispenser or wherein the adjustable dispenser is automatically adjustable and the drinking vessel position sensor is operable to sense the location of the upper opening of the drinking vessel that is supported below the dispenser during use of the alcoholic beverage forming apparatus such that the opening of the dispenser is automatically located above the upper opening of a drinking vessel or adjacent and surrounded by the upper opening of the drinking vessel during use of the alcoholic beverage forming apparatus.

10. The alcoholic beverage forming apparatus of claim 1, further including a plurality of valves and metering pumps operable to control the amount of the respective water and alcohol supplied from the respective water supply reservoir and the alcohol supply reservoir to the mixing manifold and optionally a flow meter and one or more valves operable to control an amount of carbonated water supplied from the respective carbonated water supply reservoir to the mixing manifold.

11. The alcoholic beverage forming apparatus of claim 10, wherein:

the plurality of valves are solenoid valves; and the controller is operable to control the metering pumps and solenoid valves such that predetermined proportions of water and alcohol are combined in the mixing manifold to form a final alcoholic beverage having the desired proof, temperature, and volume according to a predetermined alcoholic beverage recipe and optional adult consumer inputted options.

12. The alcoholic beverage forming apparatus of claim 1, further including a water chiller operable to chill the water of the water supply reservoir to the desired temperature before the water is supplied to the mixing manifold.

13. The alcoholic beverage forming apparatus of claim 12, wherein the alcoholic beverage forming apparatus is operable to cycle water through the water chiller via a supply line in fluid communication with the mixing manifold via a respective valve wherein a portion of the supply line is arranged to be adjacent to the outlet of the mixing manifold such that the mixing manifold, a portion of the supply line leading to the outlet of the mixing manifold, or both the mixing manifold and the portion of the supply line leading to the outlet of the mixing manifold are cooled as water is cycled through the water chiller.

14. The alcoholic beverage forming apparatus of claim 1, further including an alcohol chiller operable to chill the alcohol of the alcohol supply reservoir to the desired temperature before the alcohol is supplied to the mixing manifold.

15. The alcoholic beverage forming apparatus of claim 14, wherein the alcoholic beverage forming apparatus is operable to cycle alcohol through the alcohol chiller via a supply line in fluid communication with the mixing manifold via a respective valve wherein a portion of the supply line is arranged to be adjacent to the outlet of the mixing manifold such that the mixing manifold, a portion of the supply line leading to the outlet of the mixing manifold, or both the mixing manifold and the portion of the supply line leading to the outlet of the mixing manifold are cooled as alcohol is cycled through the alcohol chiller.

16. The alcoholic beverage forming apparatus of claim 1, further comprising an air pump configured to purge residual fluid from the interior of the beverage capsule or a portion of a supply line leading to the outlet of the mixing manifold which is in fluid communication with the beverage capsule and which supplies the alcoholic beverage mixture to the interior of the beverage capsule through the outlet of the mixing manifold.

17. The alcoholic beverage forming apparatus of claim 16, further comprising an air line valve that is operable to isolate the air pump from the alcoholic beverage mixture as the alcoholic beverage mixture is supplied to the interior of the beverage capsule.

18. The alcoholic beverage forming apparatus of claim 1, wherein the capsule holder includes a receptacle configured to receive the beverage capsule and a lid portion wherein the lid portion is operable to close the receptacle or the lid portion is fixed and the capsule holder lifts to close the receptacle.

19. The alcoholic beverage forming apparatus of claim 18, wherein the lid portion includes a top hole punch that is configured to inject the alcoholic beverage mixture into the interior of the beverage capsule through the outlet of the mixing manifold, and an upper gasket that is configured to form a liquid, gas, or both liquid and gas tight seal around the top hole punch when the lid portion closes the receptacle.

20. The alcoholic beverage forming apparatus of claim 18, wherein the capsule holder includes a bottom hole punch that is configured to form a hole in a bottom or side surface of the beverage capsule.

21. The alcoholic beverage forming apparatus of claim 20, wherein the capsule holder includes a lower gasket configured to form a liquid, gas, or both liquid and gas tight seal around a hole formed in the bottom or side surface of the beverage capsule by the bottom hole punch.

22. The alcoholic beverage forming apparatus of claim 20, wherein the bottom hole punch is conically shaped such that the size of the hole formed thereby is variably controlled by a degree to which the alcoholic beverage forming apparatus inserts the bottom hole punch into the beverage capsule such that the dispense rate of the alcoholic beverage dispensed therefrom is controlled.

23. The alcoholic beverage forming apparatus of claim 1, wherein:

the water supply reservoir includes a temperature sensor operable to measure the temperature of the water in the water supply reservoir; or the alcohol supply reservoir includes a temperature sensor operable to measure the temperature of the alcohol in the alcohol supply reservoir.

24. The alcoholic beverage forming apparatus of claim 1, wherein the water supply reservoir comprises an ambient water supply reservoir operable to supply ambient water to the mixing manifold of the alcoholic beverage forming apparatus and a cold water supply reservoir operable to supply cold water at a temperature below the ambient water temperature to the mixing manifold of the alcoholic beverage forming apparatus wherein predetermined amounts of the cold water and the ambient water are combined in the mixing manifold such that the water supplied by the alcoholic beverage forming apparatus to form the alcoholic beverage mixture is supplied at a desired temperature.

25. The alcoholic beverage forming apparatus of claim 1, wherein the alcohol supply reservoir comprises an ambient alcohol supply reservoir operable to supply an ambient alcohol to the mixing manifold of the alcoholic beverage forming apparatus and a cold alcohol supply reservoir operable to supply cold alcohol at a temperature below the ambient alcohol temperature to the mixing manifold of the alcoholic beverage forming apparatus wherein predetermined amounts of the cold alcohol and the ambient alcohol are combined in the mixing manifold such that the alcohol supplied by the alcoholic beverage forming apparatus to form the alcoholic beverage mixture is supplied at a desired temperature.

26. The alcoholic beverage forming apparatus of claim 1, wherein the alcohol supply reservoir comprises a first alcohol supply reservoir including a first type of alcohol therein and a second alcohol supply including a second type of alcohol therein wherein the mixing manifold is operable to mix predetermined amounts of the first and second types of alcohol to form the alcoholic beverage mixture.

27. The alcoholic beverage forming apparatus of claim 1, wherein the capsule holder is configured to receive multiple beverage capsules such that respective flavor mediums from more than one beverage capsule are combined to form the alcoholic beverage or such that multiple alcoholic beverages are sequentially dispensed from the alcoholic beverage forming apparatus; or the beverage forming apparatus includes multiple capsule holders each configured to receive a respective beverage capsule such that multiple alcoholic beverages are simultaneously or sequentially dispensed from the alcoholic beverage forming apparatus.

28. The alcoholic beverage forming apparatus of claim 1, wherein the capsule holder is a vibrate-able capsule holder that is configured to vibrate the beverage capsule received therein so as to facilitate mixing between the alcoholic beverage mixture delivered to the interior of the beverage capsule and the flavor medium in the interior of the beverage capsule during operation of the alcoholic beverage forming apparatus.

* * * * *